US009897949B2

(12) United States Patent
Kawano et al.

(10) Patent No.: US 9,897,949 B2
(45) Date of Patent: Feb. 20, 2018

(54) IMAGE FORMATION APPARATUS HAVING LOCKABLE AND UNLOCKABLE COVER

(71) Applicant: Oki Data Corporation, Tokyo (JP)

(72) Inventors: Masahiro Kawano, Tokyo (JP); Teruaki Kuroda, Tokyo (JP); Yoshiaki Kusakabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/384,440

(22) Filed: Dec. 20, 2016

(65) Prior Publication Data

US 2017/0185011 A1 Jun. 29, 2017

(30) Foreign Application Priority Data

Dec. 28, 2015 (JP) ..... 2015-256040

(51) Int. Cl.
*G03G 15/20* (2006.01)

(52) U.S. Cl.
CPC ..... *G03G 15/2017* (2013.01); *G03G 15/2039* (2013.01); *G03G 2215/0129* (2013.01)

(58) Field of Classification Search
CPC ..... G03G 15/2017; G03G 15/2039
USPC ..... 399/67, 328
See application file for complete search history.

(56) References Cited

U.S. PATENT DOCUMENTS 7,187,883 B2 * 3/2007 Sato ..... G03G 15/2017 399/122
2004/0197108 A1 * 10/2004 Yamagata ..... H04N 1/00981 399/21

FOREIGN PATENT DOCUMENTS

JP 2006-106668 A 4/2006

* cited by examiner

*Primary Examiner* — Quana M Grainger
(74) *Attorney, Agent, or Firm* — MetroLexis Law Group, PLLC

(57) ABSTRACT

An image formation apparatus includes: an image formation device which forms a developer image on a medium; a storage device which stores medium information concerning the medium; a fixation device which fixes the developer image to the medium by heating the developer image while causing the medium to travel; a first detector which detects a stop or a speed reduction of travel of the medium in the fixation device; a second detector which detects a temperature of the fixation device; a cooler; and a controller which, when the first detector detects the stop or the speed reduction of the travel of the medium, stops an operation of the fixation device, and operates the cooler based on the medium information and the temperature of the fixation device, thereby cooling the medium stuck in the fixation device.

13 Claims, 6 Drawing Sheets

IMAGE FORMATION APPARATUS HAVING LOCKABLE AND UNLOCKABLE COVER

CROSS REFERENCE TO RELATED APPLICATIONS

This application claims priority based on 35 USC § 119 from prior Japanese Patent Application No. 2015-256040 filed on Dec. 28, 2015, entitled "IMAGE FORMATION APPARATUS", the entire contents of which are incorporated herein by reference.

BACKGROUND OF THE INVENTION

1. Field of the Invention

This disclosure relates to an image formation apparatus that includes an image formation device which forms a developer image on a medium, and a fixation device which fixes the developer image to the medium by heating.

2. Description of Related Art

In general, an electrophotographic image formation apparatus is designed to use a fixation device to heat a developer image transferred to a medium and thus to fix the developer image to the medium. In this regard, there is proposed an image formation apparatus (see Japanese Patent Application Publication No. 2006-106668, for example), which uses a cooling fan to forcibly cool a medium after undergoing a fixation device in order to accelerate fixation of the developer image fused by the heating.

SUMMARY OF THE INVENTION

Meanwhile, if the medium has low heat resistance, the medium is at risk of being softened or fused by the heat from the fixation device in case the medium gets stuck (so-called a paper jam) in the fixation device during a printing operation. In this case, a possible consequence is that a user fails to adequately remove the stuck medium, and the stuck medium disrupts the subsequent use of the image formation apparatus.

An object of one aspect of the invention is to provide an image formation apparatus which enables a quick recovery in case of the occurrence of a stuck medium.

An aspect of the invention is an image formation apparatus includes: an image formation device which forms a developer image on a medium; a storage unit having medium information concerning the medium stored therein; a fixation device which fixes the developer image to the medium by heating the developer image while causing the medium to travel; a first detector which detects a stop or a speed reduction of travel of the medium in the fixation device; a second detector which detects a temperature of the fixation device; a cooler; and a controller which, when the first detector detects the stop or the speed reduction of the travel of the medium, stops an operation of the fixation device, and operates the cooler based on the medium information and the temperature of the fixation device, thereby cooling the medium stuck in the fixation device.

According to the aspect of the invention, it is possible to achieve a quick recovery even in case of the occurrence of a stuck medium.

DETAILED DESCRIPTION OF EMBODIMENTS

Figure 1:
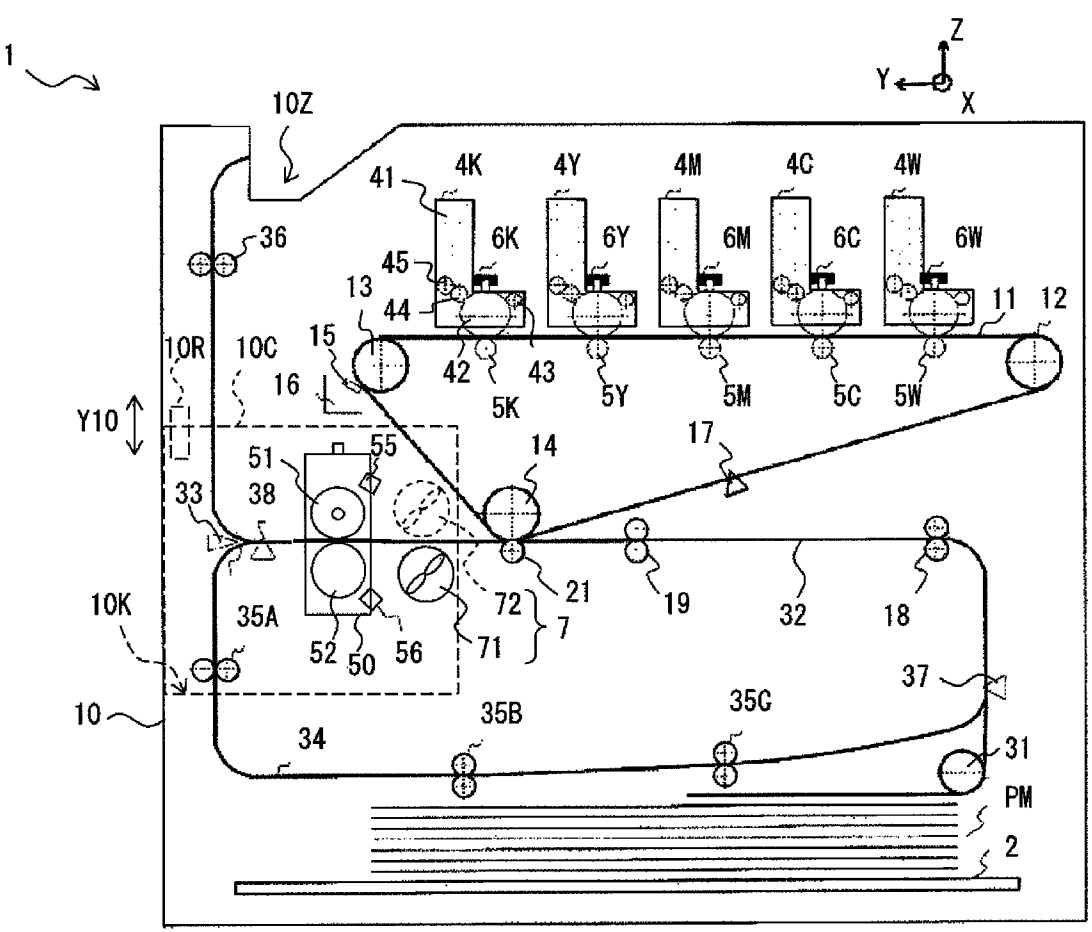
FIG. 1 is a schematic diagram illustrating an example of an overall configuration of an image formation apparatus according to embodiments of the invention.

Embodiments of the invention are described below in detail with reference to the drawings. It is to be noted that the following description represents an example of the invention, and the invention is not limited only to this aspect. In addition, it is to be also understood that the invention is not limited only to layouts, dimensions, dimensional ratios, and the like of respective constituents as illustrated in the drawings. The description is given in the following order:

1. Embodiments (an example of an image formation apparatus which determines a possibility of recovery processing by using medium information);
2. Modified Example (an example of an image formation apparatus designed to allow selection of natural cooling or forcible cooling);
3. Experimental Examples; and
4. Other Modified Examples.

<1. Embodiments>

[Configuration of Image Formation Apparatus]

FIG. 1 schematically illustrates an overall configuration example of image formation apparatus 1 according to embodiments of the disclosure. Image formation apparatus 1 corresponds to a typical example of the "image formation apparatus" of the disclosure, which is a printer that forms an image (such as a color image) by applying an electrophotographic method on medium PM such as a paper sheet or a film. Examples of medium PM include a paper sheet with a relatively high heat resistance such as plain paper, and a film made of a resin such as polyethylene (PE), polypropylene (PP), polyvinyl chloride (PVC), and polyethylene terephthalate (PET).

As illustrated in FIG. 1, image formation apparatus 1 includes paper sheet cassette (paper feed tray) 2, hopping roller (paper feed roller) 31, registration sensor (paper sheet detection sensor) 37, registration roller pair 18, conveyance roller pair 19, multiple (such as five) image formation devices 4 (4K, 4Y, 4M, 4C, and 4W), fixation device 50, and discharge rollers 36, all of which are arranged along conveyance path 32. Image formation apparatus 1 further includes intermediate transfer belt 11, driving roller 12, driven roller 13, backup roller 14, cleaning blade 15, cleaner container 16, density sensor 17, primary transfer rollers 5 (5K, 5Y, 5M, 5C, and 5W), secondary transfer roller 21, LED head or exposure devices 6 (6K, 6Y, 6M, 6C, and 6W), and cooler 7. Discharge sensor 38 and conveyance separator 33 are provided on conveyance path 32. Reconveyance rollers 35A to 35C are provided on reconveyance path 34 which branches off from conveyance path 32. Here, these components are housed inside housing 10. Opening 10K is formed in housing 10 at a position corresponding to fixation device 50. Housing 10 includes: cover 10C openably and closably provided in such a way as to cover opening 10K, and lock device 10R which locks cover 10C. Lock device 10R includes a pin, a hole or slit which is formed at the image formation apparatus body and through which the pin is to be inserted, and an actuator, for example. The pin is provided slidably in a direction indicated by arrow Y10, for example. When the pin projects from an edge of opening 10K of the image formation apparatus body by the actuator, cover 10C is locked. When the pin returns to the edge of opening 10K by the actuator, the lock on cover 10C is released (unlocked).

Paper sheet cassette 2 is a component that contains media PM in a stacked state, which is detachably attached to a lower part of housing 10.

Hopping roller 31 is a component (a sheet feeder mechanism) which picks up media PM contained in paper sheet cassette 2, one by one separately from the top, and sends media PM to registration roller pair 18.

Registration roller pair 18 is a component which sandwiches and conveys media PM sent from hopping roller 31 to intermediate transfer belt 11 while correcting a skew of each medium PM.

Registration sensor 37 is a sensor which detects the passage of each medium PM sent from hopping roller 31 in a contact or noncontact manner. When the passage of medium PM is detected, registration sensor 37 outputs an output signal to notify of the passage to external I/F 260 of controller control unit 200 (to be described later).

As illustrated in FIG. 1, image formation devices 4K, 4Y, 4M, 4C, and 4W are arranged in this order along a direction of conveyance of (the conveyance path for) medium PM (from an upstream side to a downstream side). Note that each of image formation devices 4K, 4Y, 4M, 4C, and 4W corresponds to an example of an "image formation device" of this disclosure.

Image formation devices 4K, 4Y, 4M, 4C, and 4W form developer images (toner images) on medium PM by using toners (developers) of colors different from one another.

Specifically, image formation device 4K forms a black toner image by using a black (K: blacK) toner. Image formation device 4Y forms a yellow toner image by using a yellow (Y: Yellow) toner. Image formation device 4M forms a magenta toner image by using a magenta (M: Magenta) toner. Image formation device 4C forms a cyan toner image by using a cyan (C: Cyan) toner. Image formation device 4W forms a white toner image by using a white (W: White) toner.

Each of the color toners contains a given colorant, a given release agent, a given charge control agent, a given treatment agent, and the like, and is manufactured by mixing these components as appropriate or subjecting the components to surface treatments. Among them, each of the colorant, the release agent, and the charge control agent functions as an internal additive. In contrast, for example, silica, titanium oxide, or the like is used as an external additive. Meanwhile, polyester resin is used as a binder resin, for example. In the meantime, it is possible to use one or a combination of dyes, pigments, and the like as the colorant.

Here, image formation devices 4K, 4Y, 4M, 4C, and 4W have the same configuration except that the devices form the toner images by using the toners of colors different from one another as described above. Accordingly, a description is given below of image formation device 4K as a representative of these devices.

As illustrated in FIG. 1, image formation device 4K includes toner cartridge 41, photoconductor drum 42, charge roller 43, development roller 44, and supply roller 45.

Toner cartridge 41 is a container which contains the toner of one of the above-mentioned colors. Specifically, in the example of image formation device 4K, the black toner is contained in toner cartridge 41. Likewise, the yellow toner is contained in toner cartridge 41 of image formation device 4Y, the magenta toner is contained in toner cartridge 41 of image formation device 4M, the cyan toner is contained in toner cartridge 41 of image formation device 4C, and the white toner is contained in toner cartridge 41 of image formation device 4W.

Photoconductor drum 42 is a component which carries an electrostatic latent image on its surface (a surface layer portion), and is formed by using a photoconductor (such as an organic photoconductor). Specifically, photoconductor drum 42 includes an electroconductive support and a photoconductive layer covering the outer periphery (a surface) of the electroconductive support. The electroconductive support is formed from a metal pipe made of aluminum, for example. The photoconductive layer has a structure formed by laminating a charge generation layer and a charge transport layer in this order. Photoconductor drum 42 is rotated at a predetermined circumferential speed.

Charge roller 43 is a component which charges the surface (the surface layer portion) of photoconductor drum 42, and is disposed in contact with the surface (a peripheral surface) of photoconductor drum 42. For example, charge roller 43 includes a metal shaft, and a semi-electroconductive rubber layer (such as a semi-electroconductive epichlorohydrin rubber layer) covering the outer periphery (a surface) of the metal shaft. Here, charge roller 43 described above is rotated in the opposite direction to the rotating direction of photoconductor drum 42, for example.

Development roller 44 is a component which carries the toner on its surface for developing the electrostatic latent image, and is disposed in contact with the surface (the peripheral surface) of photoconductor drum 42. For example, development roller 44 includes a metal shaft, and a semi-electroconductive urethane rubber layer covering the outer periphery (a surface) of the metal shaft. Here, development roller 44 described above is rotated in the opposite direction to the rotating direction of photoconductor drum 42 at a predetermined circumferential speed, for example.

Supply roller 45 is a component for supplying the toner contained in toner cartridge 41 to development roller 44, and is disposed such that its surface comes into contact with a surface (a peripheral surface) of development roller 44. For example, supply roller 45 includes a metal shaft, and a foamed silicone rubber layer covering the outer periphery (a surface) of the metal shaft. Here, supply roller 45 described above is rotated in the opposite direction to the rotating direction of development roller 44, for example.

Primary transfer rollers 5K, 5Y, 5M, 5C, and 5W are components for electrostatically transferring the toner images of the respective colors formed by image formation devices 4K, 4Y, 4M, 4C, and 4W onto intermediate transfer belt 11. Primary transfer rollers 5K, 5Y, 5M, 5C, and 5W are disposed opposite to respective photoconductor drums 42 of image formation devices 4K, 4Y, 4M, 4C, and 4W while interposing intermediate transfer belt 11 in-between. Here, each of primary transfer rollers 5K, 5Y, 5M, 5C, and 5W is formed from a foamed semi-electroconductive elastic rubber material, for example.

Exposure devices 6K, 6Y, 6M, 6C, and 6W are devices, such as LED heads, which irradiate the surfaces of photoconductor drums 42 with irradiation light to perform exposure, and thus form the electrostatic latent images on a surface (surface layer portions) of photoconductor drums 42. Exposure devices 6K, 6Y, 6M, 6C, and 6W are supported by housing 10. Each of exposure devices 6K, 6Y, 6M, 6C, and 6W includes, for example, light sources which emit the irradiation light, and a lens array which focuses the irradiation light on the surface of photoconductor drum 42. Here, examples of the light sources include light emitting diodes (LEDs), laser elements, and the like.

Intermediate transfer belt 11 is a belt which secondarily transfers the toner images to medium PM that is conveyed by registration roller pair 18, conveyance roller pair 19, and the like. Intermediate transfer belt 11 is stretched by driving roller 12, driven roller 13, and backup roller 14. Each of driving roller 12 and driven roller 13 is a component for moving intermediate transfer belt 11. Backup roller 14 and secondary transfer roller 21 collectively constitute a secondary transfer device. Backup roller 14 is provided such that intermediate transfer belt 11 and medium PM are held between backup roller 14 and secondary transfer roller 21. Cleaning blade 15 is a component which scrapes off the toners remaining on intermediate transfer belt 11. Cleaner container 16 is a container for storing the toners scraped off with cleaning blade 15. Density sensor 17 detects a density (a toner amount) of the toner image primarily transferred onto intermediate transfer belt 11.

Figure 2:
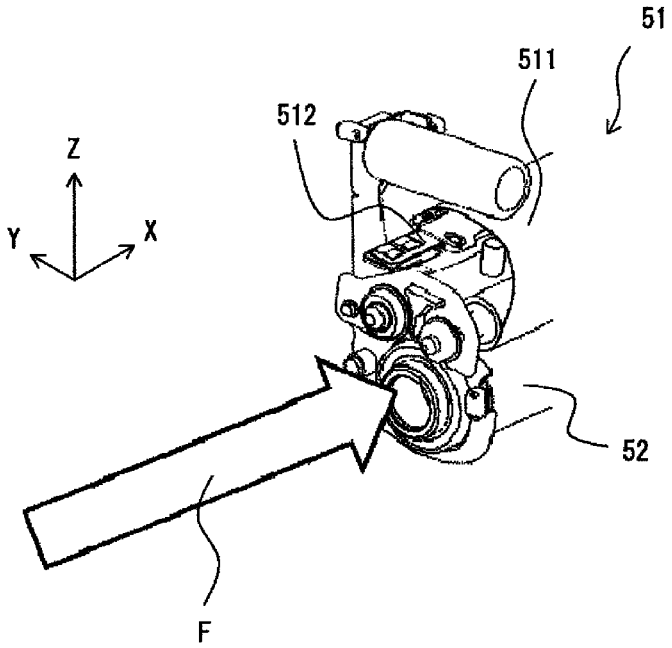
FIG. 2 is a partially enlarged perspective view illustrating a partially enlarged fixation device in the image formation apparatus depicted in FIG. 1.

Fixation device 50 is a device for applying heat and pressure to and thereby fixing the toner images on medium PM, which are transferred from intermediate transfer belt 11. FIG. 2 is an enlarged perspective view illustrating a configuration of a substantial part of fixation device 50. For example, fixation device 50 includes heating roller 51 and pressure roller 52 disposed opposite to each other while interposing conveyance path 32 to convey medium PM. Heating roller 51 includes annular fixation belt 511, and heater 512 provided inside of heating roller 51 and which heats fixation belt 511. Pressure roller 52 is pressed against heating roller 51 when fixation processing takes place, thus constituting a nipper. However, pressure roller 52 is made to be detachable from heating roller 51 during stand-by, at the time of removing medium PM when it is stuck in conveyance path 32 inside fixation device 50, and so forth. Fixation device 50 further includes heating roller temperature sensor 55 to detect a temperature of heating roller 51, and pressure roller temperature sensor 56 to detect a temperature of pressure roller 52. Heating roller temperature sensor 55 and pressure roller temperature sensor 56 detect the temperature of heating roller 51 and the temperature of pressure roller 52 either successively or at predetermined time intervals, and send output signals notifying of the temperatures to external I/f 260 (to be described later) of controller control unit 200 (to be described later). Note that heating roller temperature sensor 55 in the embodiment corresponds an example of a "second detector" of this disclosure. Pressure roller temperature sensor 56 may be used as an example of a "second detector" of the disclosure. In fixation device 50, temperature control of heating roller 51 is conducted by fixation temperature control section 340. Note that fixation device 50 corresponds to an example of a "fixation device" of this disclosure.

Discharge sensor 38 is a sensor which detects the passage of medium PM conveyed from fixation device 50 in a contact or noncontact manner, and corresponds to an example of a "first detector" of the disclosure. When the passage of medium PM is detected, discharge sensor 38 sends an output signal to notify of the passage to external I/F 260 of controller control unit 200. If no output signal from discharge sensor 38 is inputted to external I/F 260 even after a lapse of a predetermined time period since the detection of the passage of medium PM by registration sensor 37, for example, then controller control unit 200 determines that medium PM is in a state (a so-called jammed state) of being stuck on conveyance path 32 or the like inside fixation device 50. Discharge rollers 36 are guide members for discharging medium PM, to which the toner images are fixed by fixation device 50, to the outside of image formation apparatus 1. Medium PM discharged through discharge rollers 36 is stacked on stacker 10Z on an upper part of housing 10.

Cooler 7 includes blower fan 71 and exhaust fan 72. Blower fan 71 and exhaust fan 72 are disposed opposite to each other in a width direction of medium PM (an X axis direction) orthogonal to a traveling direction of medium PM, while interposing fixation device 50 in-between. Blower fan 71 takes in the air outside housing 10 and sends the air in the X axis direction, for example, to medium PM held between heating roller 51 and pressure roller 52, thereby cooling medium PM and others. Exhaust fan 72 has a function to discharge the air from blower fan 71 to the outside of housing 10. Accordingly, as indicated by arrow F in FIG. 2, an air flow in the X axis direction is formed in the vicinity of fixation device 50 by blower fan 71 and exhaust fan 72 in cooperation.

[Configuration of Control Mechanism, Etc.]

Figure 3:
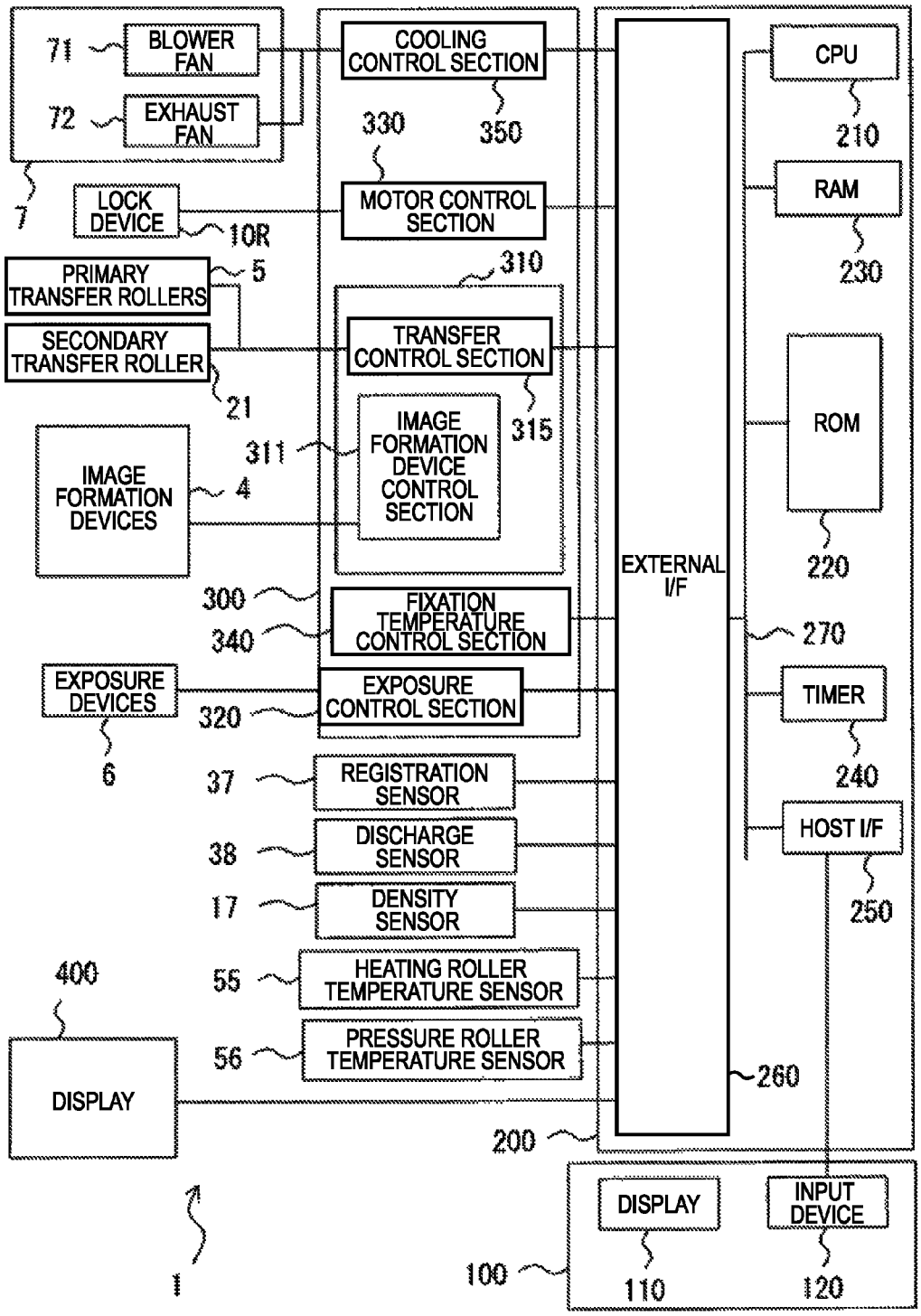
FIG. 3 is a block diagram illustrating an example of a control mechanism and the like of the image formation apparatus depicted in FIG. 1.

Here, a control mechanism of image formation apparatus 1 is described with reference to FIG. 3 as well as FIG. 1. FIG. 3 is a block diagram which illustrates an example of the control mechanism of image formation apparatus 1 together with control objects.

As illustrated in FIG. 3, in this example, the control mechanism of image formation apparatus 1 includes controller control unit 200, process control unit 300, and display 400. Display 400 displays internal information on image formation apparatus 1 and provides a user with the information visually. Display 400 corresponds to an example of an "output device" of this disclosure.

(Controller Control Unit 200)

Controller control unit 200 includes, for example, CPU (Central Processing Unit) 210, ROM (Read Only Memory) 220, RAM (Random Access Memory) 230, timer 240, host I/F 250, and external I/F 260. CPU 210, ROM 220, RAM 230, timer 240, host I/F 250, and external I/F 260 are connected to one another through internal bus 270.

CPU 210 communicates signals for controlling actions of RAM 230, timer 240, host I/F 250, and external I/F 260 in accordance with a print processing program stored in ROM 220. CPU 210 further communicates signals for controlling process control unit 300 through external I/F 260. Note that CPU 210 corresponds to an example of a "controller" of this disclosure.

ROM 220 is a domain for storing the print processing program, and is a non-volatile memory which can save data even after image formation apparatus 1 is powered off. For example, ROM 220 stores in advance of a printing operation: information on media PM (brands, thicknesses, material types, heat resistance factors, and the like); information concerning printing conditions including a temperature condition and a nipping pressure of fixation device 50, an operating speed, and the like. Note that ROM 220 as a memory corresponds to an example of a "storage unit" of this disclosure.

RAM 230 is a domain to store print data (print jobs, print commands, and so forth), which are supplied from a host device (an external device) such as a personal computer (PC) via a communication line. RAM 230 is a volatile memory storing the data which are to be erased when image formation apparatus 1 is powered off. Moreover, RAM 230 stores time information measured with timer 240 and used for various control timings. Timer 240 measures the time and outputs time data to CPU 210.

Host I/F 250 transmits and receives various control signals, print data, and the like between external apparatus 100 and CPU 210. Here, external apparatus 100 includes display 110 and input device 120, for example. Display 110 is a display device which displays print images created by a variety of application software and instructions from host I/F 250, and is formed from a liquid crystal display device and the like. Input device 120 is an input device used for creating print image data with the variety of application software, inputting medium information, and inputting response items to the instructions from host I/F 250. For example, input device 120 is formed from a keyboard, a pointing device, and the like.

External I/F 260 receives inputs of density data outputted from density sensor 17, output signals outputted from registration sensor 37 and discharge sensor 38, temperature data outputted from heating roller temperature sensor 55 and pressure roller temperature sensor 56, and the like.

(Process Control Unit 300)

Process control unit 300 includes, for example, high voltage control section 310, exposure control section 320, motor control section 330, fixation temperature control section 340, and cooling control section 350, each of which is implemented by a circuit (s).

High voltage control section 310 includes image formation device control section 311 and transfer control section 315. Image formation device control section 311 properly controls high voltages to be applied to components (charge rollers 43, development rollers 44, and supply rollers 45) in respective image formation devices 4K, 4Y, 4M, 4C, and 4W in accordance with the control of controller control unit 200. Transfer control section 315 properly controls voltages to be applied to primary transfer rollers 5K, 5Y, 5M, 5C, and 5W and secondary transfer roller 21, respectively, in accordance with the control of controller control unit 200.

Exposure control section 320 controls exposure amounts and exposure timings concerning exposure devices 6K, 6Y, 6M, 6C, and 6W.

Motor control section 330 controls actions of motors in image formation apparatus 1. Specifically, motor control section 330 controls motors which drive: the components (photoconductor drums 42, charge rollers 43, development rollers 44, and supply rollers 45) in respective image formation devices 4K, 4Y, 4M, 4C, and 4W; hopping roller 31; registration roller pair 18; conveyance roller pair 19; lock device 10R; and the like.

Fixation temperature control section 340 performs a temperature control of heating roller 51 by adjusting a voltage to be applied to heater 512 in heating roller 51 in response to output signals from heating roller temperature sensor 55 and pressure roller temperature sensor 56.

Cooling control section 350 controls actions of blower fan 71 and exhaust fan 72 of cooler 7. Note that cooling control section 350 corresponds to an example of the "controller" of this disclosure.

[Operation and Effect]

(A. Basic Actions of Image Formation Apparatus 1 as a Whole)

In image formation apparatus 1, the toner images are formed on medium PM as described below. Specifically, as illustrated in FIG. 3, when a print job is supplied from external apparatus 100 or the like to controller control unit 200 via the communication line and the like, controller control unit 200 executes print processing based on the print job, so as to cause the components in image formation apparatus 1 to perform actions as described below.

Specifically, as illustrated in FIG. 1, hopping roller 31 first picks up media PM contained in paper sheet cassette 2 one by one separately from the top, and sends media PM to registration roller pair 18 on the downstream. Each medium. PM sent from hopping roller 31 is subjected to correction of its tilt by registration roller pair 18, and is then conveyed by conveyance roller pair 19 to the secondary transfer device in which backup roller 14 and secondary transfer roller 21 are disposed opposite to each other while interposing intermediate transfer belt 11 in between. The toner images formed by image formation devices 4K, 4Y, 4M, 4C, and 4W, respectively, are transferred sequentially onto the surface of the thus conveyed medium PM through intermediate transfer belt 11.

The toner images of the respective colors are formed in image formation devices 4K, 4Y, 4M, 4C, and 4W each in accordance with the following electrophotographic process. To be more precise, first of all, the surface (the surface layer portion) of each photoconductor drum 42 is uniformly charged by charge roller 43, to which the voltage is applied from image formation device control section 311. Subsequently, illumination light is emitted from each of exposure devices 6K, 6Y, 6M, 6C, and 6W to the surface of photoconductor drum 42 to perform the exposure. Thus, the electrostatic latent images corresponding to print patterns defined by the above-mentioned print job, are formed on photoconductor drums 42.

In the meantime, each supply roller 45 to which the voltage is applied from image formation device control section 311, and each development roller 44 to which the voltage is applied from image formation device control section 311 likewise, come into contact with each other and are rotated at predetermined circumferential speeds, respectively. As a consequence of this action, the toner is supplied from supply roller 45 and is carried on the surface of development roller 44.

Subsequently, the toner on development roller 44 is charged by means of friction and the like with a toner control member (not shown) which is in contact with development roller 44. Here, the thickness of a layer of the toner on development roller 44 is determined depending on the voltage applied to development roller 44, the voltage applied to supply roller 45, a pressing pressure of the toner control member (a voltage applied to the above-mentioned toner control member), and the like.

Meanwhile, since each development roller 44 is in contact with photoconductor drum 42 corresponding thereto, the toner carried on development roller 44 adheres to the electrostatic latent image on photoconductor drum 42 as a consequence of the voltage application to development roller 44.

Thereafter, the toner (the toner image) on each photoconductor drum 42 is primarily transferred to intermediate transfer belt 11 by means of an electric field between photoconductor drum 42 and a corresponding one of primary transfer rollers 5K, 5Y, 5M, 5C, and 5W.

Furthermore, the toner images transferred to intermediate transfer belt 11 are secondarily transferred onto medium PM by the secondary transfer device. Here, in the course of the secondary transfer, the toners remaining on the surface of intermediate transfer belt 11 are scraped off and removed by cleaning blade 15, and are stored in cleaner container 16.

In this way, the toner images of the respective colors are formed by image formation devices 4K, 4Y, 4M, 4C, and 4W, and are transferred onto medium PM sequentially along the direction of conveyance. To be more precise, as illustrated in FIG. 1, image formation devices 4K, 4Y, 4M, 4C, and 4W form layers (image layers) of the toner images of the respective colors by using the toners of the corresponding colors (the black toner, the yellow toner, the magenta toner, the cyan toner, and the white toner).

Thereafter, fixation device 50 applies the heat and the pressure to the toner images on medium PM, thereby fixing the toner images to medium PM. Specifically, medium PM conveyed from the secondary transfer device to fixation device 50 is nipped by the nipper formed between fixation belt 511 and pressure roller 52, for example, and receives the heat and the pressure at the same time. Thus, the above-described fixation processing is carried out.

Lastly, medium PM thus subjected to the fixation processing is discharged to the outside of image formation apparatus 1 by using discharge rollers 36, and is stacked on stacker 10Z. Hence, an image formation operation by image formation apparatus 1 is completed.

(B. Concerning Recovery Processing in Case of the Occurrence of a Stuck Medium)

Figure 4:
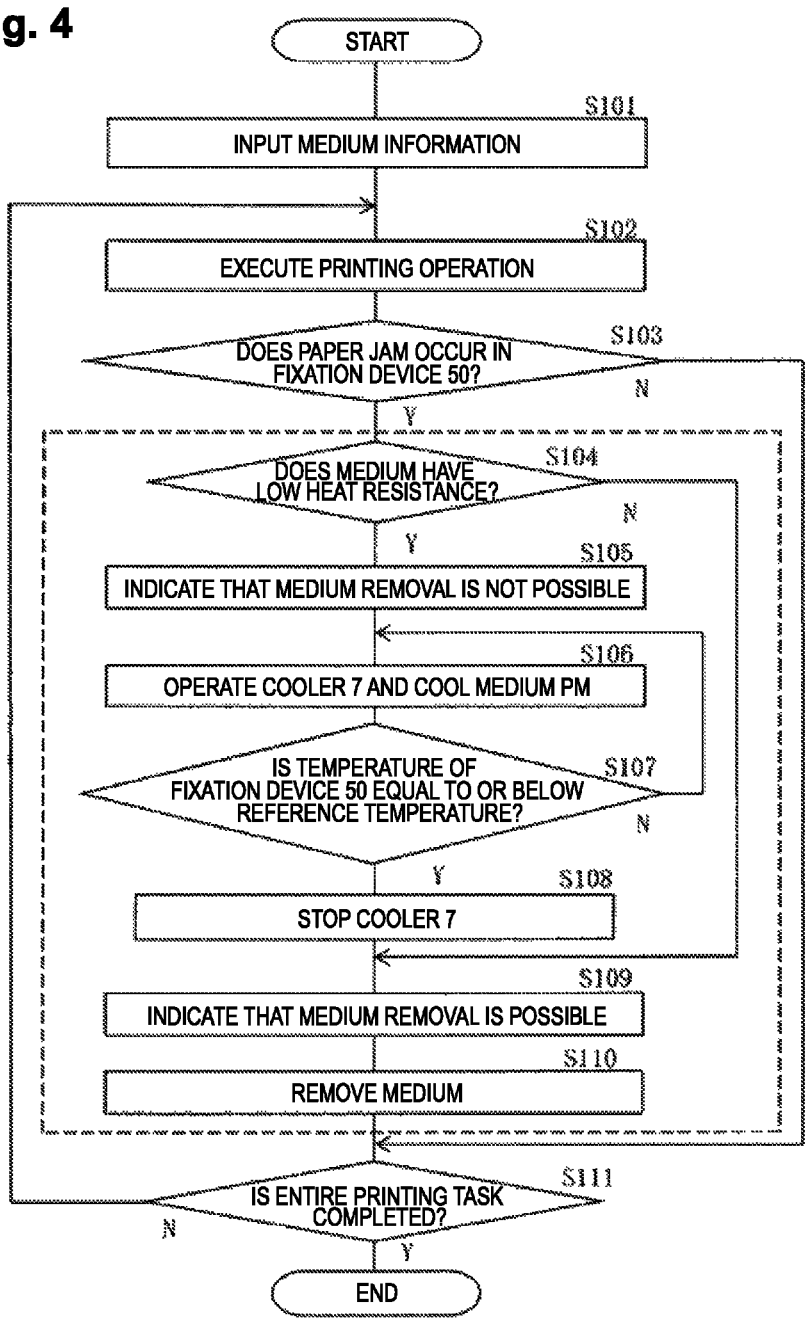
FIG. 4 is a flowchart illustrating an example of a control operation of the image formation apparatus depicted in FIG. 1.

Image formation apparatus 1 performs recovery processing in accordance with the following procedures when medium PM stops traveling inside the fixation device 50, or in other words, when medium PM gets stuck (i.e., causes a paper jam) on conveyance path 32 or the like inside fixation device 50 instead of being discharged from image formation apparatus 1. A method of the recovery processing by image formation apparatus 1 is described below with reference to FIG. 4. FIG. 4 is a flowchart illustrating an example of a control operation of image formation apparatus 1. Note that a series of processing surrounded with a dashed line in FIG. 4 corresponds to the recovery processing.

First, prior to a printing operation, the information concerning medium PM (the brand, the thicknesses, the material type, the heat resistance factor, and the like) is inputted with input device 120 of external apparatus 100, for example, and is sent to host I/F 250 (step S101). The inputted medium information is registered with ROM 220. Meanwhile, the information concerning the printing conditions including the temperature condition and the nipping pressure of fixation device 50, the operating speed, and the like is stored in ROM 220.

Next, the printing operation is executed (step S102). Here, the print data is transmitted from input device 120 of external apparatus 100 to controller control unit 200, and CPU 210 controls the actions of RAM 230, timer 240, host I/F 250, and external I/F 260 in accordance with the print processing program stored in ROM 220. Meanwhile, by way of external I/F 260, CPU 210 causes process control unit 300 to execute the printing operation.

Next, controller control unit 200 determines the presence of the occurrence of a paper jam (the stop of travel of medium PM) inside fixation device 50 (step S103). Here, if discharge sensor 38 fails to detect the passage of medium PM to be conveyed from fixation device 50 for a predetermined time period, i.e., when the paper jam inside fixation device 50 is detected (step S103Y), controller control unit 200 stops the operation of fixation device 50 and determines whether or not medium PM to be printed has a low heat resistance (step S104). The determination in step S104 is carried out on the basis of the information on medium PM registered with ROM 220 in advance. When controller control unit 200 determines in step S104 that medium PM has a low heat resistance (step S104Y), controller control unit 200 causes display 400 to display a notification that it is not possible to conduct an immediate removal of medium PM (step S105). In this case, motor control section 330 may be also used to lock cover 10C by using Lock device 10R so as to make cover 10C unopenable. By locking cover 10C as described above, it is possible to prevent a user from an erroneous operation to perform removal processing of medium PM at an inappropriate timing. In addition, controller control unit 200 causes cooling control section 350 to execute an operation of blower fan 71 and exhaust fan 72 of cooler 7 and to cool medium PM (step S106).

Thereafter, controller control unit 200 determines whether or not the temperature of fixation device 50 falls to or below a reference temperature (step S107). To be more precise, controller control unit 200, for example, determines whether or not either one or both of the temperature of heating roller 51 detected by heating roller temperature sensor 55 and the temperature of pressure roller 52 detected by pressure roller temperature sensor 56 fall to or below a reference temperature depending on the type of medium PM.

When controller control unit 200 does not determine in step S107 that the temperature of fixation device 50 falls to or below the reference temperature (step S107N), the cooling of medium PM is continued (step S106). When controller control unit 200 determines in step S107 that the temperature of fixation device 50 falls to or below the reference temperature (step S107Y), controller control unit 200 stops cooler 7 (step S108). Here, if cover 10C is locked by Lock device 10R, controller control unit 200 causes motor control section 330 to release the lock by Lock device 10R. Then, controller control unit 200 causes display 400 to display a notification that it is possible to conduct the immediate removal of medium PM (step S109).

Thereafter, controller control unit 200 completes the recovery processing upon detection of the removal of stuck medium PM (step S110). Here, the determination as to whether or not the stuck medium PM is removed is carried out, for example, by using a sensor to detect a fact that cover 10C that is once opened is closed again. Furthermore, when controller control unit 200 determines that the entire printing task is completed (step S111Y), controller control unit 200 terminates (ends) the processing as it stands.

(C. Operation and Effect of Image Formation Apparatus 1)

As described above, in the embodiments, when discharge sensor 38 detects the stop of travel of medium PM, controller control unit 200 stops the operation of fixation device 50, and operates the cooler 7 based on the medium information stored in ROM 220 and the temperature of fixation device 50, thereby cooling medium PM stuck in fixation device 50. For this reason, a situation is avoided in which medium PM is torn apart due to the heat from fixation device 50 and remains inside fixation device 50 when the user attempts to remove stuck medium PM. In this way, according to image formation apparatus 1, the user can conduct the removal processing of medium PM in fixation device 50 at an appropriate timing. Hence, even in case of the occurrence of a stuck medium, it is possible to achieve a quick recovery.

<2. Modified Example>

Next, a modified example of the above-described embodiments is described. Note that constituents of this modified example which are substantially the same as those of the above-described embodiments are denoted by the same reference numerals and descriptions thereof are omitted as appropriate.

Figure 5A:
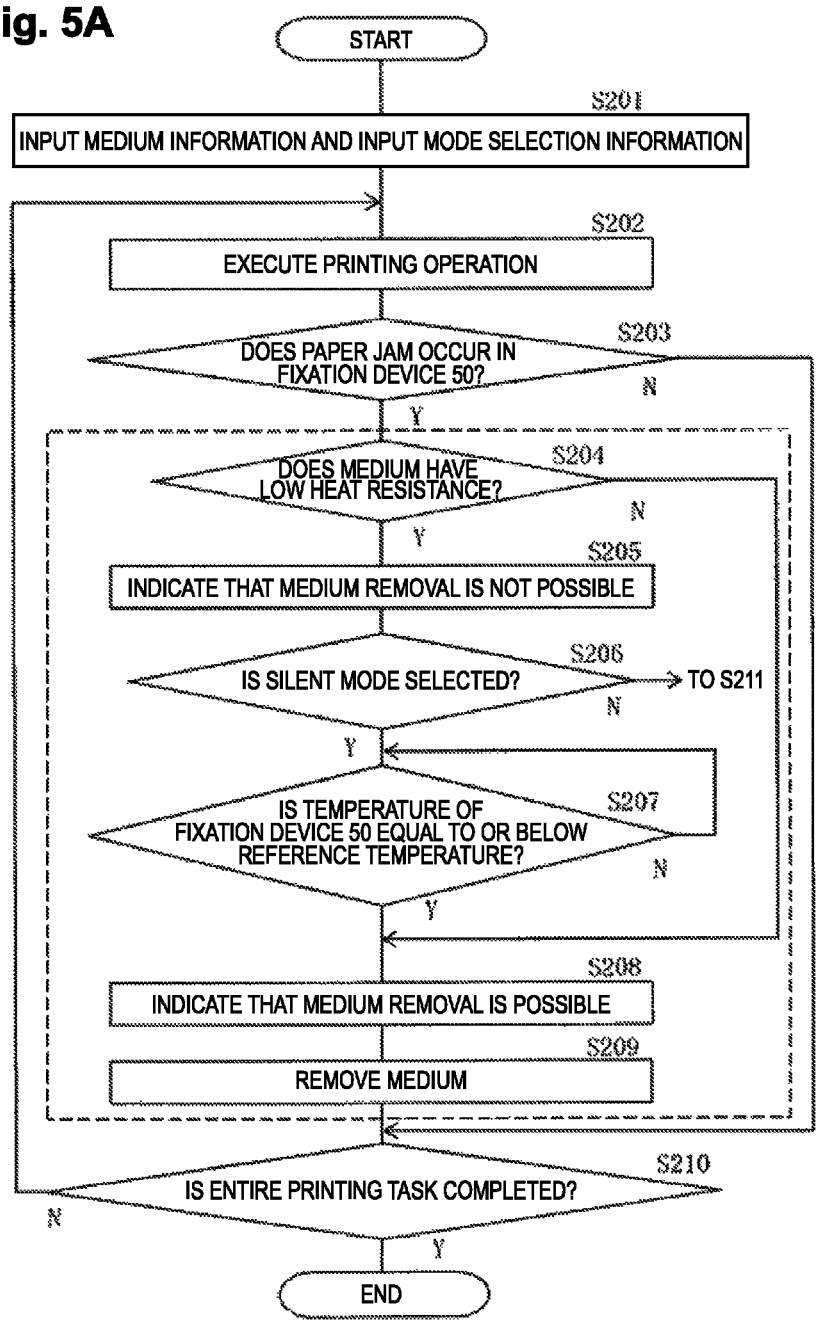
FIG. 5A is a flowchart illustrating a modified example of the control operation of the image formation apparatus depicted in FIG. 1.
Figure 5B:
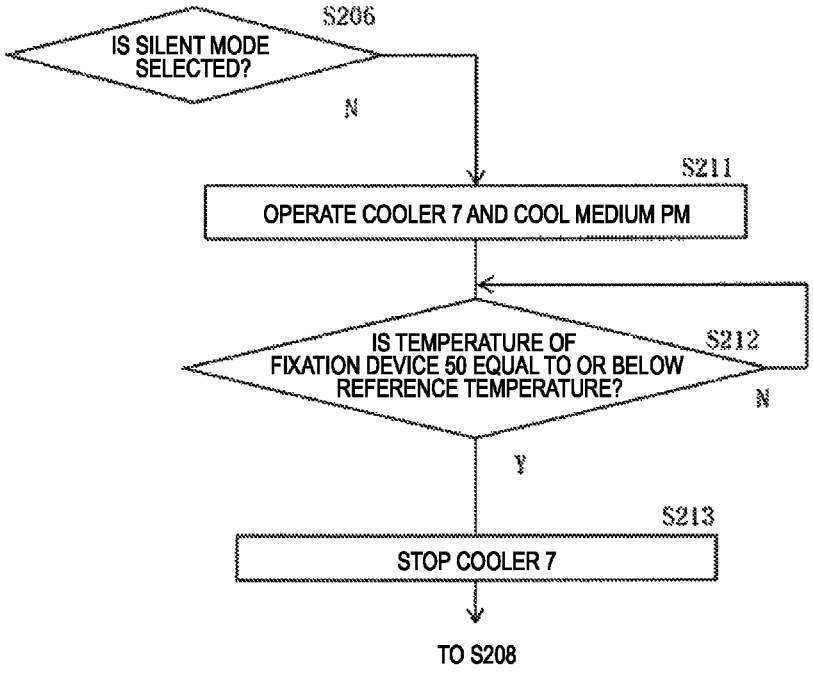
FIG. 5B is a flowchart illustrating the modified example of the control operation of the image formation apparatus depicted in FIG. 1.

In the above-described embodiments, when controller control unit 200 determines that the paper jam occurs in fixation device 50, controller control unit 200 forcibly cools medium PM by operating cooler 7 (see step S106 in FIG. 4). On the other hand, this modified example selectively performs the forcible cooling of medium PM in the recovery processing. Details are described below with reference to FIGS. 5A and 5B. FIGS. 5A and 5B are flowcharts illustrating a control operation in the recovery processing of the modified example.

As illustrated in FIG. 5A, in the modified example, mode selection information is inputted together with the input of the medium information prior to the execution of the printing operation (step S201). Specifically, the information concerning medium PM is inputted with input device 120 of external apparatus 100, for example, and is transmitted to host I/F 250. In addition, the user selects whether to perform the recovery processing in a normal mode or to perform the recovery processing in a silent mode, and mode selection information on the selected mode is transmitted from input device 120 to host I/F 250. The pieces of medium information and mode selection information thus inputted are registered with ROM 220.

Thereafter, the printing operation is executed (step S202). When controller control unit 200 determines that a paper jam occurs inside fixation device 50 (step S203Y), controller control unit 200 determines whether or not medium PM to be printed has a low heat resistance (step S204). When controller control unit 200 determines in step S204 that medium PM has a low heat resistance (step S204Y), controller control unit 200 causes display 400 to display a notification that it is not possible to conduct an immediate removal of medium PM (step S205). Here, motor control section 330 may be also used to lock cover 10C by using Lock device 10R so as to make cover 10C unopenable.

Subsequently, controller control unit 200 determines whether or not the recovery processing in the silent mode is selected, on the basis of the mode selection information registered with ROM 220 in advance (step S206). When controller control unit 200 determines in step 206 that the silent mode is selected (step S206Y), controller control unit 200 subjects medium PM to natural cooling (step S207) until controller control unit 200 determines that the temperature of fixation device 50 falls to or below the reference temperature.

On the other hand, when controller control unit 200 determines in step S206 that the silent mode is not selected (step S206N), i.e., that the normal mode is selected, controller control unit 200 subjects medium PM to the forcible cooling. Specifically, as illustrated in FIG. 5B, controller control unit 200 causes cooling control section 350 to execute the operation of blower fan 71 and exhaust fan 72 of cooler 7 and to cool medium PM (step S211). Thereafter, controller control unit 200 determines whether or not the temperature of fixation device 50 falls to or below the reference temperature (step S212). When controller control unit 200 determines in step S212 that the temperature of fixation device 50 falls to or below the reference temperature (step S212Y), controller control unit 200 stops cooler 7 (step S213).

When the temperature of fixation device 50 is determined to fall to or below the reference temperature (steps S207Y and S212Y), controller control unit 200 causes motor control section 330 to release the lock by Lock device 10R if cover 10C is locked by Lock device 10R. Then, controller control unit 200 causes display 400 to display the notification that it is possible to conduct the immediate removal of medium PM (step S208).

Lastly, controller control unit 200 completes the recovery processing upon detection of the removal of stuck medium PM (step S209). Here, the determination as to whether or not the stuck medium PM is removed is carried out, for example, by using the sensor to detect the fact that cover 10C that is once opened is closed again. Furthermore, when controller control unit 200 determines that the entire printing task is completed (step S210Y), controller control unit 200 terminates (ends) the processing as it stands.

As described above, in this modified example, the operation mode in the recovery processing is selected, and the determination as to whether to perform the forcible cooling or to perform the natural cooling is made on the basis of the selected mode. Thus, it is possible to eliminate any annoyance at night or under a quiet environment, for example, which may be caused by the operating noises of blower fan 71, exhaust fan 72, and the like. In the modified example, the mode selection information is inputted together with the input of the medium information, and these pieces of information are stored in ROM 220 prior to the execution of the printing operation. However, the invention is not limited only to this configuration. For example, the mode selection information may be inputted after the start of the printing operation, namely, during the printing operation, at a point of occurrence of a stuck medium (a paper jam) in fixation device 50 or the like device, or the like timing for example.

<3. Experimental Examples>

Experimental Example 1

Next, the recovery processing by image formation apparatus 1 described in the embodiments is conducted as Experimental Example 1. Then, the presence of residues of medium PM inside fixation device 50 is examined. A result is indicated in Table 1. In Table 1, the symbol o in the column titled residues represents that for example, medium PM is not torn so that torn medium PM does not remain inside fixation device. Meanwhile, the symbol x therein represents that for example, medium PM is torn so that torn medium PM remains inside fixation device 50.

TABLE 1

| | Medium | Fixation Temperature [° C.] | Forcible Cooling | Waiting Time [sec.] | Heating Roller Temperature [° C.] | Residues |
|---|---|---|---|---|---|---|
| Experimental Example 1 | Low Melting Point Medium | 150 | YES | 120 | 70 | o |
| Experimental Example 2 | Low Melting Point Medium | 150 | NO | 1200 | 70 | o |
| Experimental Example 3 | Plain Paper | 150 | NO | 10 | 155 | o |
| Experimental Example 4 | Low Melting Point Medium | 150 | NO | 10 | 155 | x |

Here, a low melting point medium containing polyethylene as its main component and having a heatproof temperature of 90° C. is used as medium PM, and the forcible cooling is performed by cooler 7. Moreover, fixation device 50 is subjected to the temperature control such that the temperature to be detected by the heating roller temperature sensor 55 becomes equal to 150° C. Here, medium PM is cooled continuously for 120 seconds, then cover 10C is immediately opened and medium PM is subjected to the removal processing. In this case, for example, medium PM is not torn so that medium PM does not remain inside fixation device 50. Here, the temperature of heating roller 51 at that point is equal to 70° C.

Experimental Example 2

Next, as Experimental Example 2, the recovery processing is conducted under the same conditions as those of Experimental Example 1 described above, except that the natural cooling is conducted for 1200 seconds without performing the forcible cooling by use of cooler 7. Then, the presence of residues of medium PM inside fixation device 50 is examined. Table 1 also indicates a result of this example. Also in Experimental Example 2, for example, medium PM is not torn so that torn medium PM does not remain inside fixation device 50. Here, the temperature of heating roller 51 at that point is equal to 70° C. as with Experimental Example 1.

Experimental Example 3

Next, as Experimental Example 3, the recovery processing is conducted under the same conditions as those of Experimental Example 1 described above, except that plain paper is used as medium PM and, the removal processing of medium PM is performed soon (about 10 seconds) after the occurrence of the paper jam without conducting the forcible cooling by use of cooler 7. Then, the presence of residues of medium PM inside fixation device 50 is examined. Table 1 also indicates a result of this example. Also in Experimental Example 3, for example, medium PM is not torn so that torn medium PM does not remain inside fixation device 50. Here, the temperature of heating roller 51 at that point is equal to 135° C.

Experimental Example 4

Next, as Experimental Example 4, the recovery processing is conducted under the same conditions as those of Experimental Example 1 described above, except that the removal processing of medium PM is performed soon (about 10 seconds) after the occurrence of the paper jam without conducting the forcible cooling by use of cooler 7. Then, the presence of residues of medium PM inside fixation device 50 is examined. Table 1 also indicates a result of this example. In Experimental Example 4, medium PM gets torn inside fixation device 50, and the residues of medium PM are present between heating roller 51 and pressure roller 52. Here, the temperature of heating roller 51 at that point is equal to 135° C.

From the results of Experimental Examples 1 to 4 described above, it is successfully confirmed that the embodiments can suppress the occurrence of residues of medium PM inside fixation device 50, by conducting the forcible cooling or providing an appropriate cooling time period depending on the heat resistance property (such as the melting point) of medium PM.

<4. Other Modified Examples>

The invention is described above with reference to the embodiments, the modified example, and the experimental examples. However, the invention is not limited thereto and various other modifications are possible. For instance, the above-described embodiments and others describe the image formation apparatus which forms color images. However, without limitation to the foregoing, the invention is also applicable to an image formation apparatus which forms black-and-while images by transferring only the black toner, for example. In addition, the above-described embodiments and others describe the image formation apparatus adapted to the secondary transfer method. However, the invention is also applicable to an image formation apparatus adapted to a direct transfer method.

In the meantime, the series of processing described in the embodiments and others may be carried out by means of hardware (circuits) or software (programs). If the processing is carried out by the software, then the software includes a group of programs for causing a computer to execute the respective functions. The programs may be used by being preinstalled on the computer, or by being installed on the computer from a network or a storage medium.

Meanwhile, in the above-described embodiments, display 400 is provided as an example of the output device, and the notification that it is possible to conduct the removal processing of medium PM is displayed on display 400 based on the control signal from external I/F 260. However, the invention is not limited to this aspect. For instance, lamps of different colors may be turned on and off depending on the situations so as to allow the user to visually recognize whether or not the removal processing of medium PM is possible. Further, the invention is not limited to the above-mentioned visual communication method. For example, voice guidance, alarms, and the like may be used to allow the user to aurally recognize whether or not the removal processing of medium PM is possible.

Moreover, the invention is not limited to the configuration in which the temperature control of fixation device 50 is performed only on the basis of the detection signal from heating roller temperature sensor 55, but may also be configured to perform such temperature control only on the basis of the detection signal from pressure roller temperature sensor 56. Alternatively, the temperature control may be performed on the basis of these two types of detection signals. Furthermore, the temperature control may be performed while also taking into account temperature information from any other devices.

Meanwhile, the above-described embodiments are configured to input the medium information and the like from external apparatus 100 which is separate from image formation apparatus 1. However, the invention is not limited to this configuration. For instance, display 400 may be formed from a touch panel so as to function as the input device for inputting the medium information and inputting the response items to the instructions from host I/F 250. Alternatively, image formation apparatus 1 may be provided with an input device for allowing the user to input various kinds of information, as a constituent that is different from display 400.

Furthermore, the embodiments describe the image formation apparatus provided with the print function as a typical example of the "image formation apparatus" of the disclosure. However, the invention is not limited to this aspect. Specifically, the invention is also applicable to an image formation apparatus that serves as a multifunction machine, which includes a scan function and a facsimile function in addition to the print function, for example.

Furthermore, in the above-described embodiments, process control unit including high voltage control section 310, exposure control section 320, motor control section 330, fixation temperature control section 340, and cooling control section 350 is implemented by circuits. However, each of these control section may be implemented by a hardware, a software, or a combination thereof.

Note that the image forming apparatus may stop the operation of fixation device 50 and operate cooler 7 when the speed reduction of the travel of the medium PM is detected by discharge sensor 38 but the complete stop of the travel of the medium PM is not detected.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image formation device which forms a developer image on a medium;

a storage unit having medium information concerning the medium stored therein;

a fixation device which fixes the developer image to the medium by heating the developer image while causing the medium to travel;

a first detector which detects a stop or a speed reduction of travel of the medium in the fixation device;

a second detector which detects a temperature of the fixation device;

a controller;

a housing which houses the fixation device, and includes an opening provided at a position corresponding to a position of the fixation device;

an openable and closeable cover to cover the opening; and a lock device which locks the cover, wherein the controller:

causes the lock device to lock the cover when a heatproof temperature of the medium contained in the medium information is equal to or below a predetermined threshold, and causes the lock device to unlock the cover when the temperature of the fixation device detected by the second detector is equal to or below a reference temperature based on the medium information.

2. The image formation apparatus according to claim 1, further comprising an output device, wherein the controller transmits a control signal to the output device when the controller determines that a removal processing of the medium is possible, and the output device outputs a notification that the removal processing of the medium is possible, based on the control signal.

3. The image formation apparatus according to claim 2 wherein the controller determines that the removal processing of the medium is possible when the temperature of the fixation device is equal to or below the reference temperature based on the medium information, and transmits the control signal to the output device.

4. The image formation apparatus according to claim 1, further comprising an input device to which the medium information is inputted.

5. The image formation apparatus according to claim 1, further comprising a cooler, wherein when the first detector detects the stop or the speed reduction of the travel of the medium, the controller stops an operation of the fixation device and operates the cooler based on the medium information and the temperature of the fixation device, thereby cooling the medium stuck in the fixation device.

6. The image formation apparatus according to claim 5 wherein the cooler includes a blower fan and an exhaust fan, and the blower fan and the exhaust fan are disposed opposite to each other in a width direction of the medium orthogonal to a traveling direction of the medium while interposing across the fixation device in the width direction.

7. The image formation apparatus according to claim 6, further comprising an output device, wherein the controller transmits a control signal to the output device when the controller determines that a removal processing of the medium is possible, and the output device outputs a notification that the removal processing of the medium is possible, based on the control signal.

8. The image formation apparatus according to claim 7, wherein the controller determines that the removal processing of the medium is possible when the temperature of the fixation device is equal to or below the reference temperature based on the medium information, and transmits the control signal to the output device.

9. The image formation apparatus according to claim 5 wherein the controller operates the cooler when a melting point of the medium contained in the medium information is equal to or below a predetermined threshold and when the temperature of the fixation device detected by the second detector is higher than the reference temperature based on the medium information.

10. The image formation apparatus according to claim 5, wherein the fixation device includes a first roller and a second roller, the second detector includes a first sensor which detects a temperature of the first roller, and a second sensor which detects a temperature of the second roller, and the controller operates the cooler when both of the temperature of the first roller and the temperature of the second roller is higher than the reference temperature based on the medium information.

11. The image formation apparatus according to claim 5, wherein the controller operates the cooler when a first operation mode is selected from the first operation mode and a second operation mode, and the controller keeps the cooler from operating when the second operation mode is selected.

12. An image formation apparatus comprising:

an image formation device which forms a developer image on a medium;

a storage unit having medium information concerning the medium stored therein;

a fixation device which fixes the developer image to the medium by heating the developer image while causing the medium to travel;

a first detector which detects travel of the medium in the fixation device;

a second detector which detects a temperature of the fixation device;

a controller;

a housing which houses the fixation device, and includes an opening provided at a position corresponding to a position of the fixation device;

an openable and closeable cover to cover the opening; and a lock device which locks the cover, wherein the controller causes the lock device to lock the cover when a heatproof temperature of the medium contained in the medium information is equal to or below a predetermined threshold, and the controller causes the lock device to unlock the cover when the temperature of the fixation device detected by the second detector is equal to or below a reference temperature based on the medium information.

13. The image formation apparatus according to claim 12, further comprising a cooler, wherein when the first detector detects the stop or the speed reduction of the travel of the medium, the controller stops an operation of the fixation device and operates the cooler based on the medium information and the temperature of the fixation device, thereby cooling the medium stuck in the fixation device.

* * * * *